US011532884B1

(12) United States Patent
Coutts et al.

(10) Patent No.: US 11,532,884 B1
(45) Date of Patent: Dec. 20, 2022

(54) INTERLEAVED PHASED ARRAY ANTENNAS

(71) Applicant: Amazon Technologies, Inc., Seattle, WA (US)

(72) Inventors: Gordon Coutts, Woodinville, WA (US); Alireza Mahanfar, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 61 days.

(21) Appl. No.: 16/819,982

(22) Filed: Mar. 16, 2020

(51) Int. Cl.

| | |
|---|---|
| ***H01Q 5/30*** | (2015.01) |
| ***H01Q 3/34*** | (2006.01) |
| ***H01Q 21/06*** | (2006.01) |
| ***H01Q 5/307*** | (2015.01) |

(52) U.S. Cl.
CPC ..... *H01Q 3/34* (2013.01); *H01Q 5/307* (2015.01); *H01Q 21/061* (2013.01)

(58) Field of Classification Search
CPC ..... H01Q 3/34; H01Q 5/307; H02Q 21/061; H02Q 21/062; H02Q 21/065; H02Q 21/068
See application file for complete search history.

(56) References Cited

U.S. PATENT DOCUMENTS

| | | | | |
|---|---|---|---|---|
| 2018/0316098 | A1* | 11/2018 | Amadjikpe | H01Q 9/0457 |
| 2019/0081414 | A1* | 3/2019 | Kao | H01Q 5/42 |
| 2020/0259248 | A1* | 8/2020 | Lv | H01Q 21/0025 |

* cited by examiner

*Primary Examiner* — Seokjin Kim
(74) *Attorney, Agent, or Firm* — Lowenstein Sandler LLP

(57) ABSTRACT

Technologies directed to interleaved phased array antennas are described. One apparatus includes a support structure, a fist antenna array, and a second antenna array. The first antenna array includes a first set of antenna elements disposed on a surface of the support structure. The first set of antenna elements is spaced apart by a first distance. The second antenna array includes a second set of antenna elements disposed on the surface of the support structure. The second set of antenna elements is located in spaces between the first set of antenna elements on the surface and the second set of antenna elements is spaced apart by a second distance that is less than the first distance.

18 Claims, 7 Drawing Sheets

INTERLEAVED PHASED ARRAY ANTENNAS

BACKGROUND

A large and growing population of users is enjoying entertainment through the consumption of digital media items, such as music, movies, images, electronic books, and so on. The users employ various electronic devices to consume such media items. Among these electronic devices (referred to herein as endpoint devices, user devices, clients, client devices, or user equipment) are electronic book readers, cellular telephones, Personal Digital Assistants (PDAs), portable media players, tablet computers, netbooks, laptops, and the like. These electronic devices wirelessly communicate with a communications infrastructure to enable the consumption of the digital media items. In order to communicate with other devices wirelessly, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
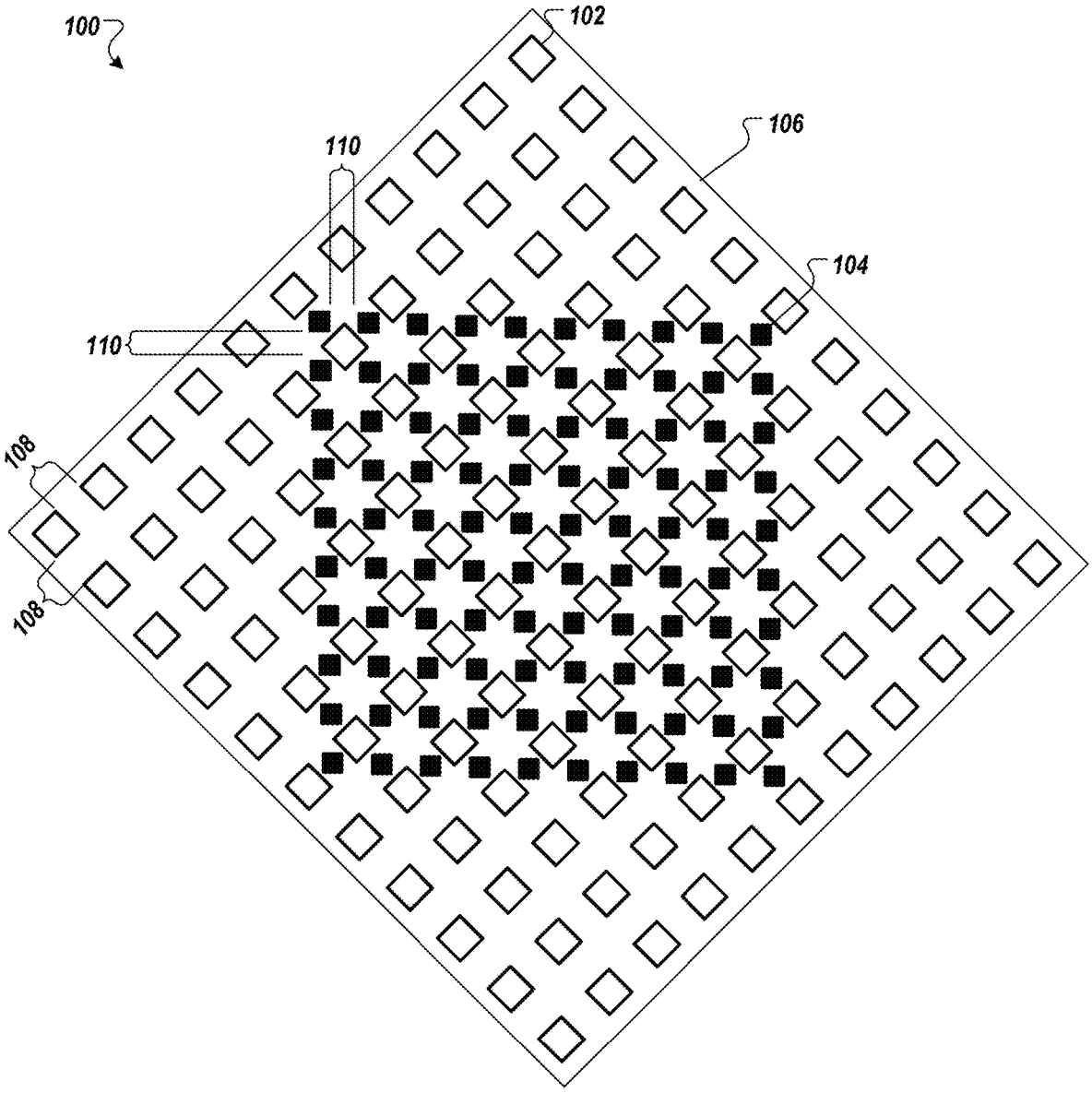
FIG. 1 illustrates an antenna structure with two interleaved phased array antennas on a support structure according to one embodiment.

Technologies directed to interleaved phased array antennas are described. Conventionally, wireless devices that have multiple phased array antennas would have separate printed circuit boards (PCBs), each PCB including one of the multiple phased array antennas. The phased array antenna synthesizes a specified electric field (phase and amplitude) across an aperture and the elements are spaced apart with a specified inter-element spacing value (e.g., a distance between any two elements of the phased array antenna. As a result, wireless device with multiple phased array antennas have multiple apertures, one aperture per phased array antenna. A user terminal that communicates with a satellite using a first frequency band for downlink communications and another frequency band for uplink communications include two separate PCBs with two separate apertures. An aperture refers to an absence of materials above the antenna elements of the phased array antenna that allows the antenna elements to radiate electromagnetic energy in order to send a signal (TX signal) to another device or receive and measure an incoming signal (RX signal) at the antenna elements. In some cases, there may be some protective material in the aperture above the antenna elements that does not affect the sending and receiving of wireless signals. The multiple apertures and the corresponding PCBS contribute to the size and cost of the wireless device.

Aspects of the present disclosure overcome the deficiencies of conventional wireless device by interleaving the position of the multiple phased array antennas in a single aperture. Aspects of the present disclosure can allow two phased array antennas, operating in different frequency bands, to share an aperture. One apparatus includes a support structure, a fist antenna array, and a second antenna array. The first antenna array includes a first set of antenna elements disposed on a surface of the support structure. The first set of antenna elements is spaced apart by a first distance. That is, two adjacent antenna elements of the first set of elements are separated by the first distance. The second antenna array includes a second set of antenna elements disposed on the surface of the support structure. The second set of antenna elements is located in spaces between the first set of antenna elements on the surface and the second set of antenna elements is spaced apart by a second distance that is less than the first distance. That is, two adjacent antenna elements of the second set of antenna elements are separated by the second distance and each antenna element of the second of elements is disposed between two adjacent antenna elements of the first set of antenna elements. One factor in the design of antenna arrays is inter-element spacing. This is typically designed as a compromise between competing figures of merit: number of elements for a given total array aperture and performance at the design scan angle. Aspects of the present disclosure can provide a number of elements of a second antenna array with a second inter-element spacing in between spaces of a number of elements of a first antenna array with a first inter-element spacing that is larger than the second inter-element spacing. In some cases, the first antenna array is a low frequency array and the second antenna array is a high frequency array. The high frequency array has smaller antenna elements than the low frequency array since the size of the individual elements is proportional to wavelength. The high frequency array elements are more closely spaced than the low frequency elements since the size is proportional to wavelength. The smaller elements of the high frequency array can be designed to fit in the gaps between the elements of the low frequency array. In some cases, the high frequency array can be rotated 45 degrees with respect to the low frequency array to have a square root of two ratio (e.g., $\sqrt{2}$ ratio) between array elements spacing. The $\sqrt{2}$ ratio is close to a 1.5 element spacing ratio for antennas operating in the 20 GHz and 30 GHz satellite communication bands (e.g., approximately 18.3-31 GHz). In other cases, other angles and relative positioning can be used to enable different ratios between array elements spacing for other combinations of frequency bands. For example, on frequency within the band can be selected as corresponding to the minimum distances between adjacent elements, as well as the size of the elements themselves. For example, the high frequency array can operate at 30 GHz, corresponding to a wavelength of approximately 10 mm. The size of the elements and the distance between adjacent elements can be selected as being proportional to the corresponding wavelength. The low frequency array can operate at 20 GHz, corresponding to a wavelength of approximately 15 mm. The size of the elements and the distance between adjacent elements can be selected as being proportional to this corresponding wavelength. Any frequency in the frequency band can be selected to determine a corresponding wavelength that is proportional to the size and distances.

Aspects of the present disclosure can overcome the deficiencies of conventional wireless devices by providing an identical unit cell (also referred to as identical tiles) for ease of manufacturing. Aspects of the present disclosure can use modules or submodules that are identical to facilitate manufacturing, assembly, and part management. The unit cell can be manufactured as a single stock keeping unit (SKU). Each unit cell includes some elements of the first phased array antenna and some elements of the second phased array antenna. When combined together, the collection of unit cells results in specific repeated patterns to create the interleaved phased array antennas in a single aperture.

Aspects of the present disclosure can overcome the deficiencies of conventional wireless devices by providing sequential rotation of array elements in each of the phased array antenna. That is, feed orientation of the antenna elements can be done in a rotation to improve circular polarization performance. For the exemplary 20/30 GHz frequency bands, the tile geometry enables simultaneous sequential rotation of the two phased array antennas with a single tile. Aspects of the present disclosure can provide a single tile geometry that enables cost reduction in high-volume manufacturing. As a result, the multiple interleaved phased array antennas can be built with the antenna modules with a systematic, scalable, and easy to manufacture approach.

FIG. 1 illustrates an antenna structure 100 with two interleaved phased array antennas 102, 104 on a support structure 106 according to one embodiment. A first phased array antenna 102 includes a first set of antenna elements disposed on a surface of the support structure 106. The support structure 106 can be a circuit board, such as a PCB, or other structures upon which the antenna elements can be positioned. The first set of antenna elements is organized as a first grid. The first grid has a first inter-element spacing of a first distance 108 between each of the first set of antenna elements. That is, a first inter-element spacing value is equal to the first distance. Each of the first set of antenna elements has a first size that is proportional to a first wavelength corresponding to a frequency of a first frequency band. The first phased array antenna 102 can be coupled to a first radio that operates in the first frequency band. The radio can include a baseband processor and radio frequency front-end (RFFE) circuitry. Alternatively, the first phased array antenna 102 can be coupled to other communication systems, such as RF radio, microwave radios, or other signal source or receivers. A second phased array antenna 104 includes a second set of antenna elements disposed on the surface of the support structure 106. The second set of antenna elements is organized as a second grid. The second grid has a second inter-element spacing of a second distance 110 between each of the second set of antenna elements. Each of the second set of antenna elements has a second size that is proportional to a second wavelength corresponding to a frequency of the second frequency band, the second frequency band being higher in frequency than the first frequency band. The second phased array antenna 104 can be coupled to a second radio that operates in the second frequency band. Alternatively, the first phased array antenna 102 and the second phased array antenna 104 can be coupled to a radio that operates in both the first frequency band and the second frequency band. The second distance 110 is less than the first distance 108 and the second size is less than the first size. The second grid is rotated 45 degrees with respect to the first grid and each of the second set of antenna elements fits within the first inter-element spacing of the first grid in an interleaved fashion with the first set of antenna elements. That is, the elements of the second phased array antenna 104 are interleaved with elements of the first phased array antenna 102 and the elements of the second phased array antenna 104 are disposed in the gaps created by the first inter-element spacing in the first grid. The second inter-element spacing of the second grid is smaller than the first inter-element spacing. Alternatively, the second grid can be rotated at other angle values with respect to the first grid. Of course, the first grid can be rotated by an angle from the second grid as well.

Figure 3:
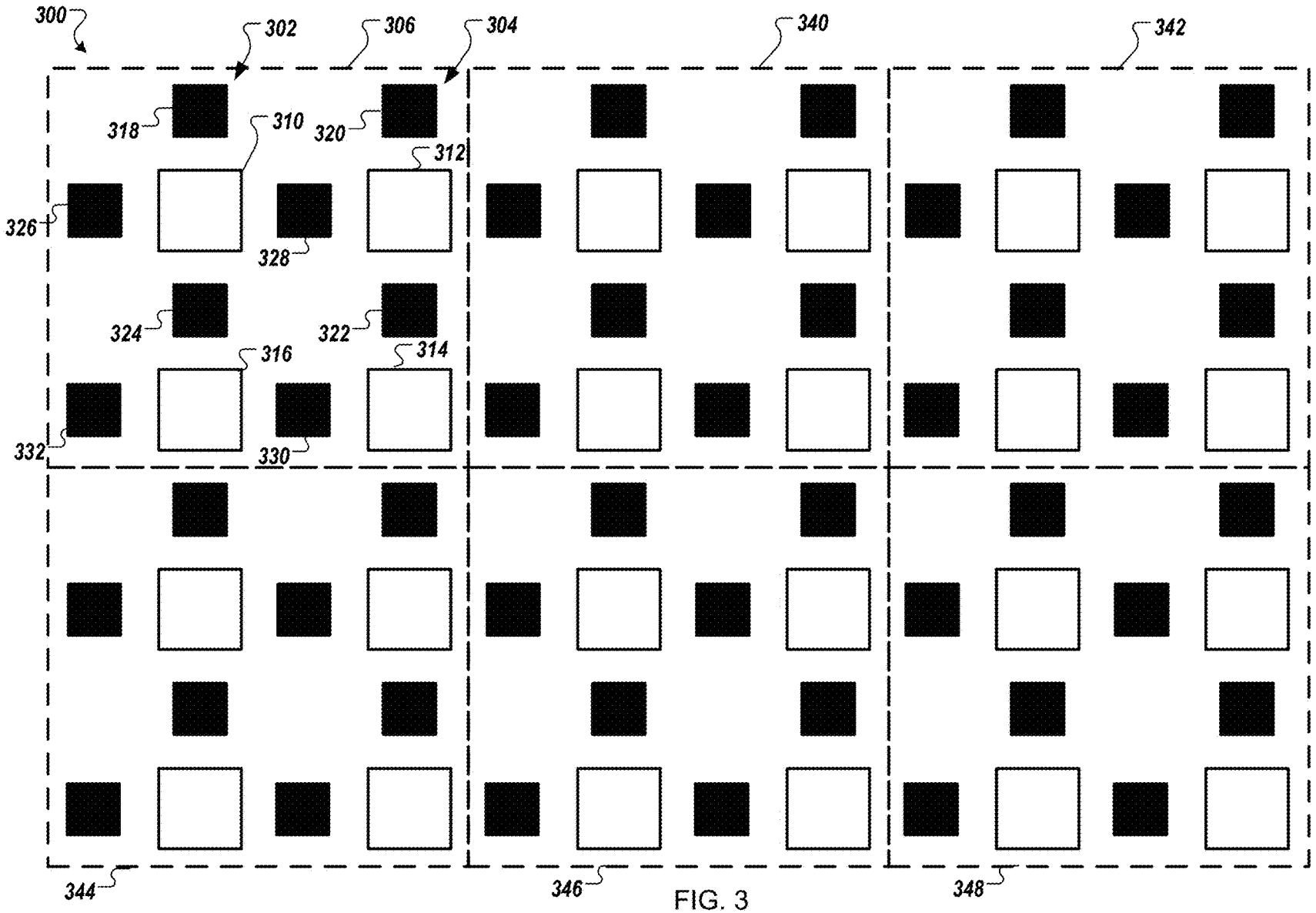
FIG. 3 illustrates a portion of two interleaved phased array antennas made up of six unit cells according to one embodiment.
Figure 4A:
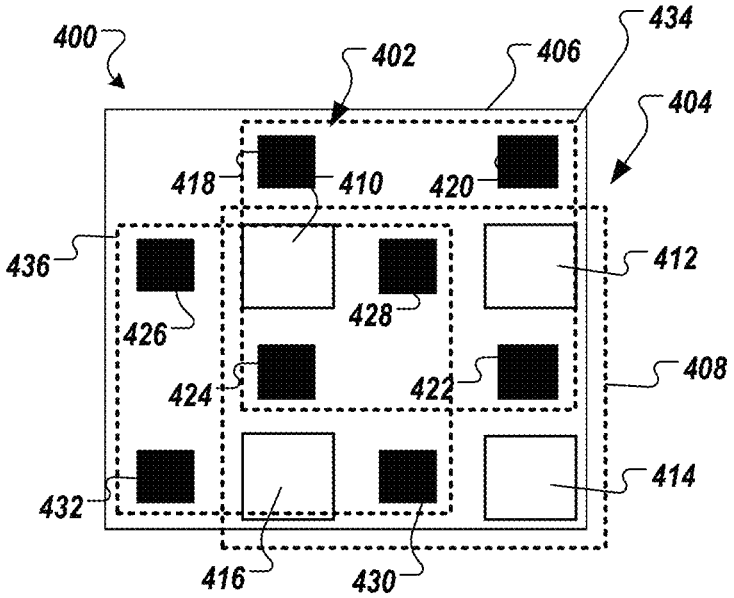
FIG. 4A illustrates a single unit cell having four elements that form a first square shape and eight elements that form a second square shape and a third square shape according to one embodiment.
Figure 4B:
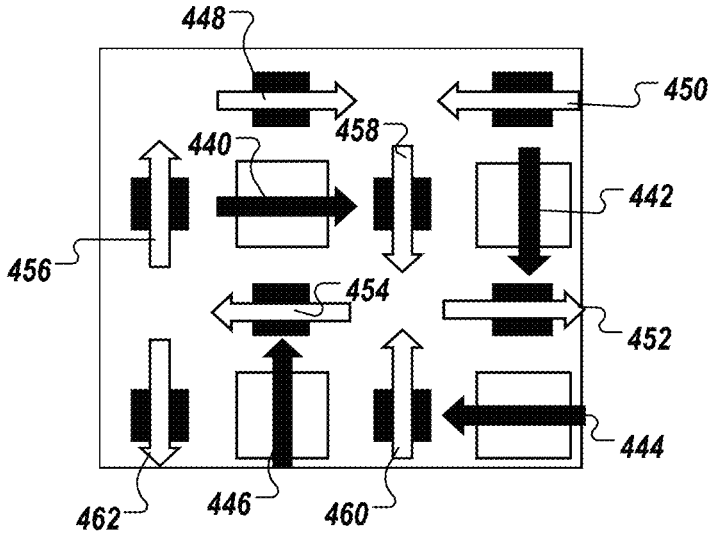
FIG. 4B illustrates a sequential rotation of feeds of the elements of the single unit cell of FIG. 4A according to one embodiment.
Figure 5:
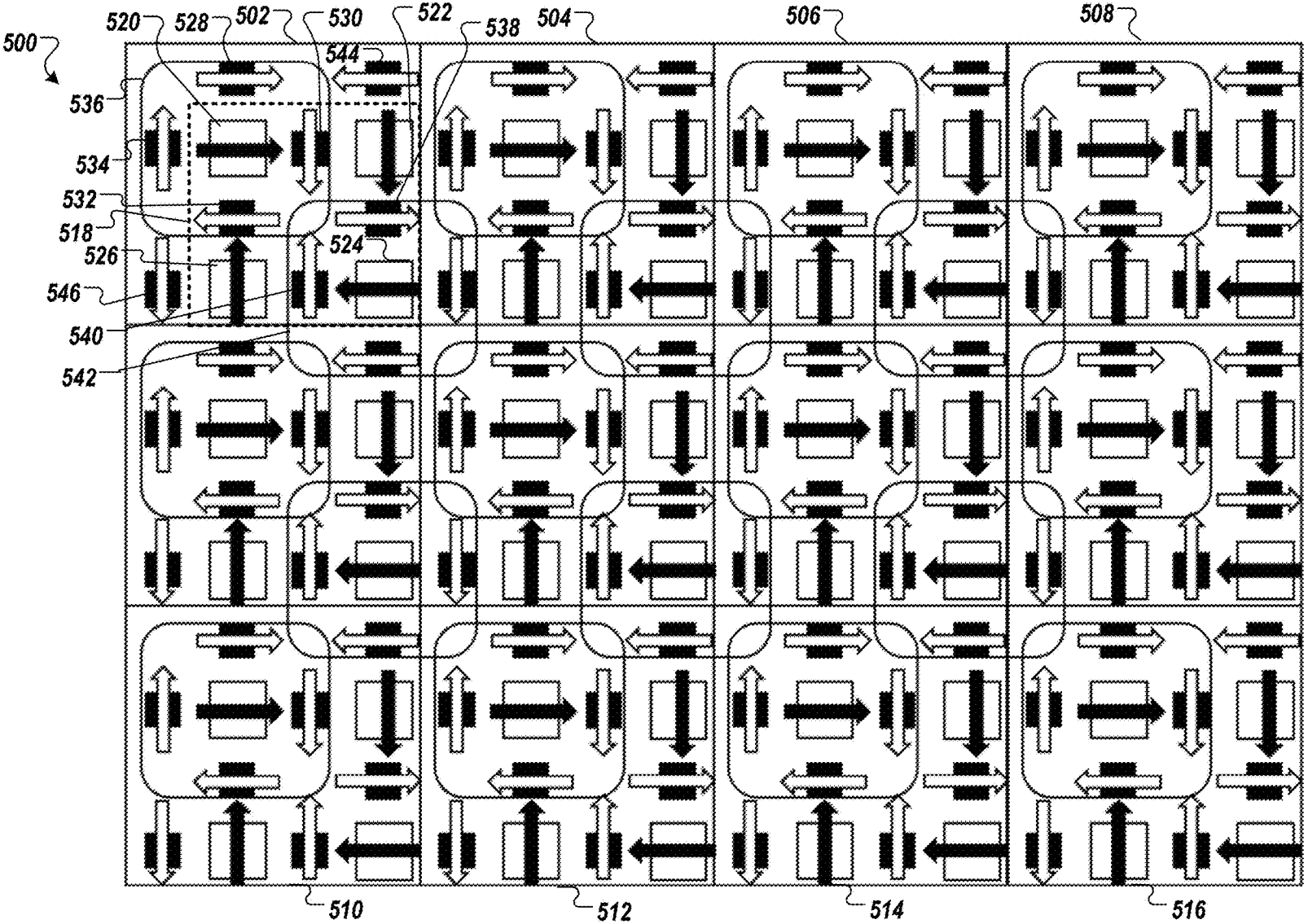
FIG. 5 illustrates a portion of two interleaved phased array antennas made up of twelve unit cells with sequential rotation of feeds according to one embodiment.

As described in more detail with respect to FIGS. 3-5, the first phased array antenna 102 and the second phased array antenna 104 are constructed with multiple unit cells. The unit cells can also be considered identical tiles. Each of the multiple unit cells can include some antenna elements of the first phased array antenna 102 and some antenna elements of the second phased array antenna 104. In one implementation, the unit cell includes four antenna elements of the first phased array antenna 102 and eight antenna elements of the second phased array antenna 104. Alternatively, each unit cell includes two antenna elements of the first phased array antenna 102 and four antenna elements of the second phased array antenna 104.

As described in more detail with respect to FIGS. 4B-5, the first phased array antenna 102 and the second phased array antenna 104 can each have sequential rotations of elements to improve circular polarization performance. For example, each of the unit cells can include: i) a first element coupled to a first feed with a first orientation, ii) a second element coupled to a second feed with a second orientation, iii) a third element coupled to a third feed with a third orientation, the third orientation being opposite the first orientation, and iv) a fourth element coupled to a fourth feed with a fourth orientation, the fourth orientation being opposite the second orientation, wherein the first element, the second element, the third element, and the fourth element are organized in a first square pattern. This first square pattern can be referred to as a "full sequential rotation block" since the full rotation of the feeds in the four orientations is on the same unit cell (same tile). Some of the feeds of other elements can be a partial sequential rotation block that spans multiple unit cells (multiple tiles). The unit cell also includes v) a fifth element coupled to a fifth feed with the first orientation, vi) a sixth element coupled to a sixth feed with the second orientation, vii) a seventh element coupled to a seventh feed with the third orientation, and viii) an eighth element coupled to an eighth feed with the fourth orientation. The fifth element, the sixth element, the seventh element, and the eighth element are organized in a second square pattern. The unit cell also includes ix) a ninth element coupled to a ninth feed with the first orientation, and x) a tenth element coupled to a tenth feed with the fourth orientation. The ninth element and the tenth element are part of a third square pattern with elements from at least two adjacent unit cells. The unit cell also includes xi) an eleventh element coupled to an eleventh feed with the third orientation. The eleventh element is part of a fourth square pattern with elements from at least two adjacent unit cells. The unit cell also includes xii) a twelfth element coupled to a twelfth feed with the second orientation. The twelfth element is part of a fifth square pattern with elements from at least two adjacent unit cells of the plurality of unit cells.

It should be noted that although described above as a single feed per element, in other embodiments, each feed can be a multi-point feed, such as dual-point feed, a quad-point feed, or the like. In the case of two feeds on a single element, the two feeds still have an orientation. Adjacent elements, each with two feeds per element, can have different orientations for a full sequential rotation that span multiple adjacent unit cells or a full sequential rotation within a single unit cell. It should also be noted that antenna elements can be active antenna elements or terminated elements. A terminated element is an antenna element that is terminated to a matched load. An active antenna element is an antenna element that is coupled to a signal source, such as a radio or a microwave source.

Figure 2:
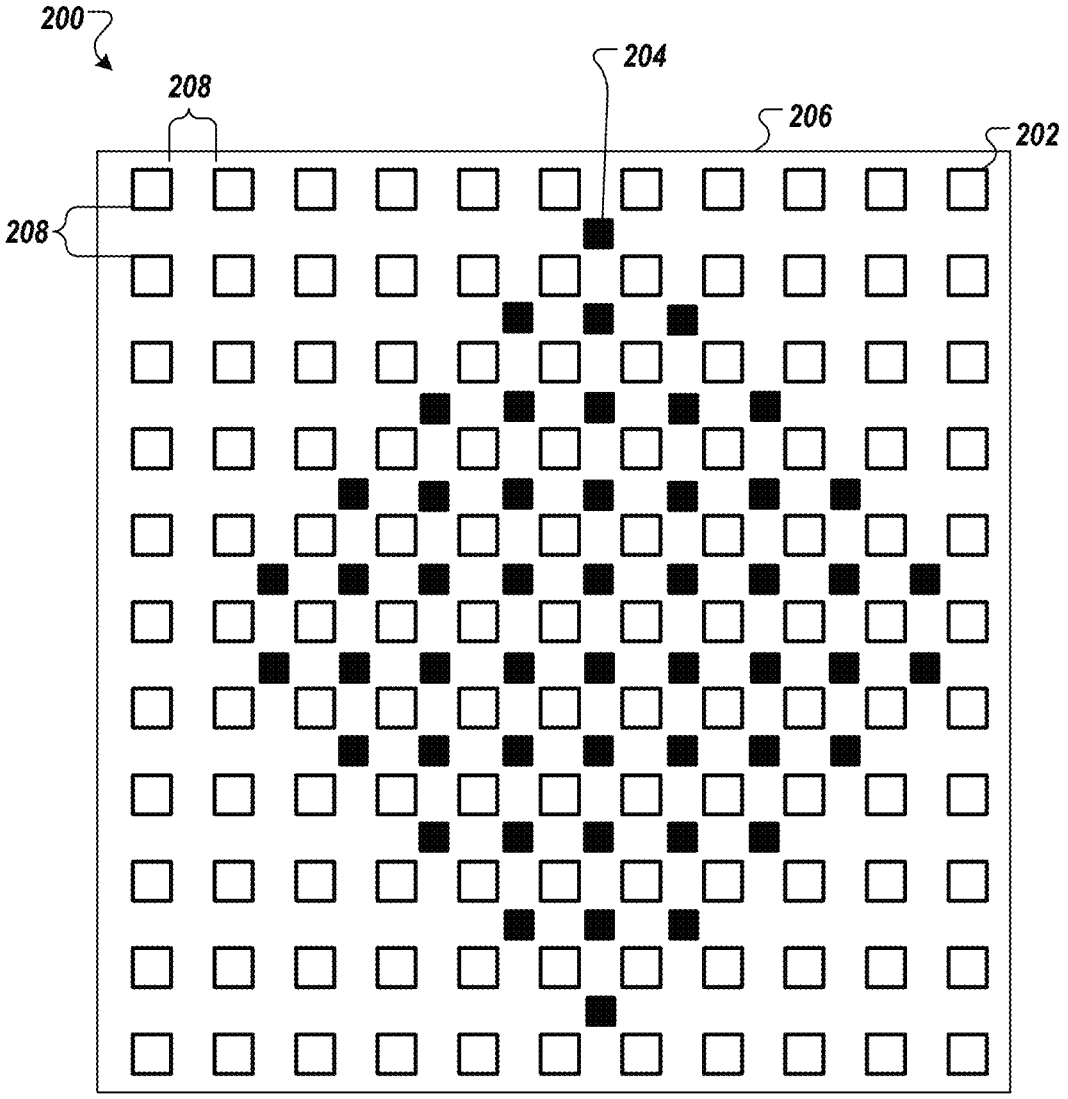
FIG. 2 illustrates an antenna structure with two interleaved phased array antennas on a support structure according to another embodiment.

FIG. 2 illustrates an antenna structure 200 with two interleaved phased array antennas 202, 204 on a support structure 206 according to another embodiment. The antenna structure 200 is similar to the antenna structure 100 of FIG. 1, except as noted below. A first phased array antenna 202 includes a first set of antenna elements disposed on a surface of the support structure 206. The first set of antenna elements is organized as a first grid. The first grid has a first inter-element spacing of a first distance 208 between each of the first set of antenna elements. A second phased array antenna 204 includes a second set of antenna elements disposed on the surface of the support structure 206. The second set of antenna elements is organized as a second grid. The second grid has a second inter-element spacing of a second distance 210 between each of the second set of antenna elements. The second distance 110 is less than the first distance 108 and the second size is less than the first size. The second grid is rotated 45 degrees with respect to the first grid and each of the second set of antenna elements fits within the first inter-element spacing of the first grid in an interleaved fashion with the first set of antenna elements. However, unlike the second grid of FIG. 1, each of the second set of antenna elements of the second grid in FIG. 2 is oriented in a similar fashion as each of the first set of elements of the first grid. The elements in the second set of elements in FIG. 1 appear as diamond shapes, whereas the elements in the second set of elements in FIG. 2 appear as square shape or shapes with the same orientation as the shapes of the first set of elements. In other embodiments, other shapes of elements can be used. Also, in other embodiments, other shapes of unit cells can be used. The size of the elements and the unit cells can also vary based on the application.

As illustrated in FIGS. 1 and 2, the orientation of the antenna elements can vary between the first phased array antenna and the second phased array antenna. Although illustrated as squares, each antenna element can have different shapes collectively or individually.

Similar to the second phased array antenna 104, the elements of the second phased array antenna 204 are interleaved with elements of the first phased array antenna 202 and the elements of the second phased array antenna 204 are disposed in the gaps created by a first inter-element spacing in the first grid. The second inter-element spacing of the second grid is smaller than the first inter-element spacing.

Similar to the antenna structure 100, the antenna structure 200 can be constructed with multiple unit cells. Also, similar to the first phased array antenna 102 and the second phased array antenna 104, the first phased array antenna 202 and the second phased array antenna 204 can each have sequential rotations of elements to improve circular polarization performance as described below with respect to FIGS. 4B-5.

FIG. 3 illustrates a portion 300 of two interleaved phased array antennas 302, 304 made up of six unit cells 306 according to one embodiment. As illustrated in FIG. 3, multiple unit cells 306 can be combined to make up the two interleaved phased array antennas 302, 305. The unit cells 306 can be identical for ease of manufacturing, assembly, and part management. The unit cell 306, for example, can be a single SKU. As illustrated in FIG. 3, each unit cell includes some elements of the first phased array antenna 302 and some elements of the second phased array antenna 304. When combined together, the collection of unit cells 306 results in specific repeated patterns to create the interleaved phased array antennas in a single aperture.

As illustrated in FIG. 3, the unit cell 306 includes twelve elements 310-332. More specifically, the first phased array antenna 302 includes a first element 310, a second element 312, a third element 314, and a fourth element 316. The first element 310, the second element 312, the third element 314, and the fourth element 316 are arranged in a first square shape, with each of the four elements being arranged at a corner of the first square shape. The second phased array antenna 304 includes two sets of four elements, totaling eight elements. The first set includes a fifth element 318, a sixth element 320, a seventh element 322, and an eighth element 324. Each of the first set is arranged at a corner of a second square shape. The second square shape is positioned to straddle two of the four elements of the first square shape (e.g., 310, 312) in a first direction. The second set includes a ninth element 326, a tenth element 328, an eleventh element 330, and a twelfth element 332. Each of the second set is arranged at a corner of a third square shape. The third square shape is positioned to straddle two of the four elements of the first square shape (e.g., 310, 316) in a second direction that is orthogonal to the first direction.

A unit cell 340 is positioned to be adjacent to a first side of the unit cell 306. The unit cell 340 can be identical to the unit cell 306. Another identical unit cell 342 is positioned to be adjacent to a first side of the unit cell 340. Another identical unit cell 344 is positioned to be adjacent to a second side of the unit cell 306. Another identical unit cell 346 is positioned to be adjacent to a first side of the unit cell 344. Another identical unit cell 348 is positioned to be adjacent to a first side of the unit cell 346. Although six unit cells are illustrated as a portion of the two interleaved phased array antennas 302, 304, in other embodiments, other numbers of unit cells can be used to form the interleaved phased array antennas 302, 304.

In another embodiment, a unit cell could include half of the elements of the unit cell 306. In another embodiment, a unit cell could include double the elements of the unit cell 306.

Each of the unit cells can be made up of a support structure, such as a PCB, and the elements are disposed on a surface of the support structure. The support structures of the multiple unit cells can be connected together or disposed on another support structure. Once constructed, the two interleaved phased array antennas can be disposed in a single aperture as described herein.

FIG. 4A illustrates a single unit cell 400 having four elements that form a first square shape 408 and eight elements that form a second square shape 434 and a third square shape 436 according to one embodiment. As illustrated in FIG. 4A, each single unit cell 400 includes some elements of the first phased array antenna 402 and some elements of the second phased array antenna 404. As illustrated in FIG. 4A, the unit cell 400 includes a first element 410, a second element 412, a third element 414, and a fourth element 416 that are part of the first phased array antenna 402. The first element 310, the second element 312, the third element 314, and the fourth element 316 are arranged in the first square shape 408 (or square pattern), with each of the four elements being arranged at a corner of the first square shape 408. The second phased array antenna 404 includes two sets of four elements, totaling eight elements. The first set includes a fifth element 418, a sixth element 420, a seventh element 422, and an eighth element 424. Each of the first set is arranged at a corner of a second square shape 434. The second square shape 434 is positioned to straddle two elements (e.g., 410, 412) of the four elements of the first square shape 408 in a first direction. The second set includes a ninth element 426, a tenth element 428, an eleventh element 430, and a twelfth element 432. Each of the second set is arranged at a corner of a third square shape 436. The third square shape 436 is positioned to straddle two elements (e.g., 310, 316) of the four elements of the first square shape 408 in a second direction that is orthogonal to the first direction.

When the single unit cells 400 is combined together with other unit cells, the collection of unit cells form an interleaved phased array antenna structure with two phased array antennas that are positioned within a single aperture.

In one embodiment, the first phased array antenna 402 and the second phased array antenna 404 can each have sequential rotations of elements to improve circular polarization performance, such as illustrated below with respect to FIGS. 4B-5. That is, the elements of the single unit cell 400 can have feed orientations that rotate around the particular set, such as the first square shape 408 for the first phased array antenna 402 or the second and third square shapes 434, 436 for the second phased array antenna 404.

FIG. 4B illustrates a sequential rotation of feeds of the elements of the single unit cell 400 of FIG. 4A according to one embodiment. For simplicity of the drawing and explanation, the elements of FIG. 4B are the same elements as labeled in FIG. 4A. The first element 410 is coupled to a first feed with a first orientation 440. The second element 412 is coupled to a second feed with a second orientation 442. The third element 414 is coupled to a third feed with a third orientation 444, the third orientation 444 being opposite the first orientation 440. The fourth element 416 is coupled to a fourth feed with a fourth orientation 446, the fourth orientation 446 being opposite the second orientation 442. As such, the first element, the second element, the third element, and the fourth element are organized in the first square shape 408 with a sequential rotation of the feeds.

The fifth element 418 is coupled to a fifth feed with the first orientation 448. The sixth element 420 is coupled to a sixth feed with the third orientation 450 that is opposite the first orientation. The seventh element 422 is coupled to a seventh feed with the first orientation 452. The eighth element 424 is coupled to an eighth feed with the third orientation. Although the fifth element, the sixth element, the seventh element, and the eighth element are organized in a second square shape 434, these elements can be part of different sets of sequential rotations of feeds. As described below, the fifth element 418, tenth element 428, eighth element 424, and the ninth element 426 can form a sequential rotation of feeds as illustrated in FIGS. 4B and 5.

The ninth element 426 is coupled to a ninth feed with the fourth orientation 456. The tenth element 428 is coupled to a tenth feed with the second orientation 458. The eleventh element 430 is coupled to an eleventh feed with the fourth orientation 460. The twelfth element 432 is coupled to a twelfth feed with the second orientation 462. Alternatively, the feed patterns can sequentially rotate in other patterns. Also, as noted herein, some of the rotations of feeds are full rotations within the single unit cell 400, such as the full sequential rotation of feeds for the first square shape 408 of elements. The single unit cell 400 can also include one or more partial sequential rotations of feeds that combine with partial sequential rotations of feeds from neighboring unit cells, such as shown in FIG. 5.

FIG. 5 illustrates a portion 500 of two interleaved phased array antennas made up of twelve unit cells 502-516 with sequential rotation of feeds according to one embodiment. A first unit cell 502 includes a full sequential rotation of feeds 518 for elements of a first phased array antenna. As illustrated, the first unit cell 502 includes i) a first element 520 coupled to a first feed with a first orientation, ii) a second element 522 coupled to a second feed with a second orientation, iii) a third element 524 coupled to a third feed with a third orientation, the third orientation being opposite the first orientation, and iv) a fourth element 526 coupled to a fourth feed with a fourth orientation, the fourth orientation being opposite the second orientation. The first element 520, the second element 522, the third element 524, and the fourth element 526 are organized in a first square pattern. This first square pattern can be referred to as a "full sequential rotation block" since the full rotation of the feeds in the four orientations is on the same unit cell (same tile). Only the full sequential rotation of feeds 518 is illustrated and labeled in the first unit cell 502, but the other unit cells include a similar full sequential rotation of feeds for the first phased array antenna.

The first unit cell 502 also includes a full sequential rotation of feeds 536 for elements of a second phased array antenna. As illustrated, the first unit cell 502 also includes v) a fifth element 528 coupled to a fifth feed with the first orientation, vi) a sixth element 530 coupled to a sixth feed with the second orientation, vii) a seventh element 532 coupled to a seventh feed with the third orientation, and viii) an eighth element 534 coupled to an eighth feed with the fourth orientation. The fifth element 528, the sixth element 530, the seventh element 532, and the eighth element 534 are organized in a second square pattern. This second square pattern can be referred to as a "full sequential rotation block" since the full rotation of the feeds in the four orientations is on the same unit cell (same tile). Only the full sequential rotation of feeds 536 is illustrated and labeled in the first unit cell 502, but the other unit cells include a similar full sequential rotation of feeds for the second phased array antenna.

Some of the feeds of other elements can be a partial sequential rotation block that spans multiple unit cells (multiple tiles). As illustrated, the first unit cell 502 also includes ix) a ninth element 538 coupled to a ninth feed with the first orientation, and x) a tenth element 540 coupled to a tenth feed with the fourth orientation. The ninth element 538 and the tenth element 540 are part of a third square pattern 542 with elements from at least two adjacent unit cells. The first unit cell 502 also includes xi) an eleventh element 544 coupled to an eleventh feed with the third orientation. The eleventh element 544 is part of a fourth square pattern with elements from one or more adjacent unit cells (one in the illustrated first unit cell but a similar element in another cell could be part of a square pattern with elements from two adjacent unit cells. The first unit cell 502 also includes xii) a twelfth element 546 coupled to a twelfth feed with the second orientation. The twelfth element 546 is part of a fifth square pattern with elements from one or more adjacent unit cells. The third and fourth square patterns can be referred to as "partial sequential rotation block" since the full rotation of the feeds in the four orientations is not on the same unit cell (same tile). The partial sequential rotations of feeds are not labeled in the first unit cell 502, but are repeated through the other unit cells.

Figure 6:
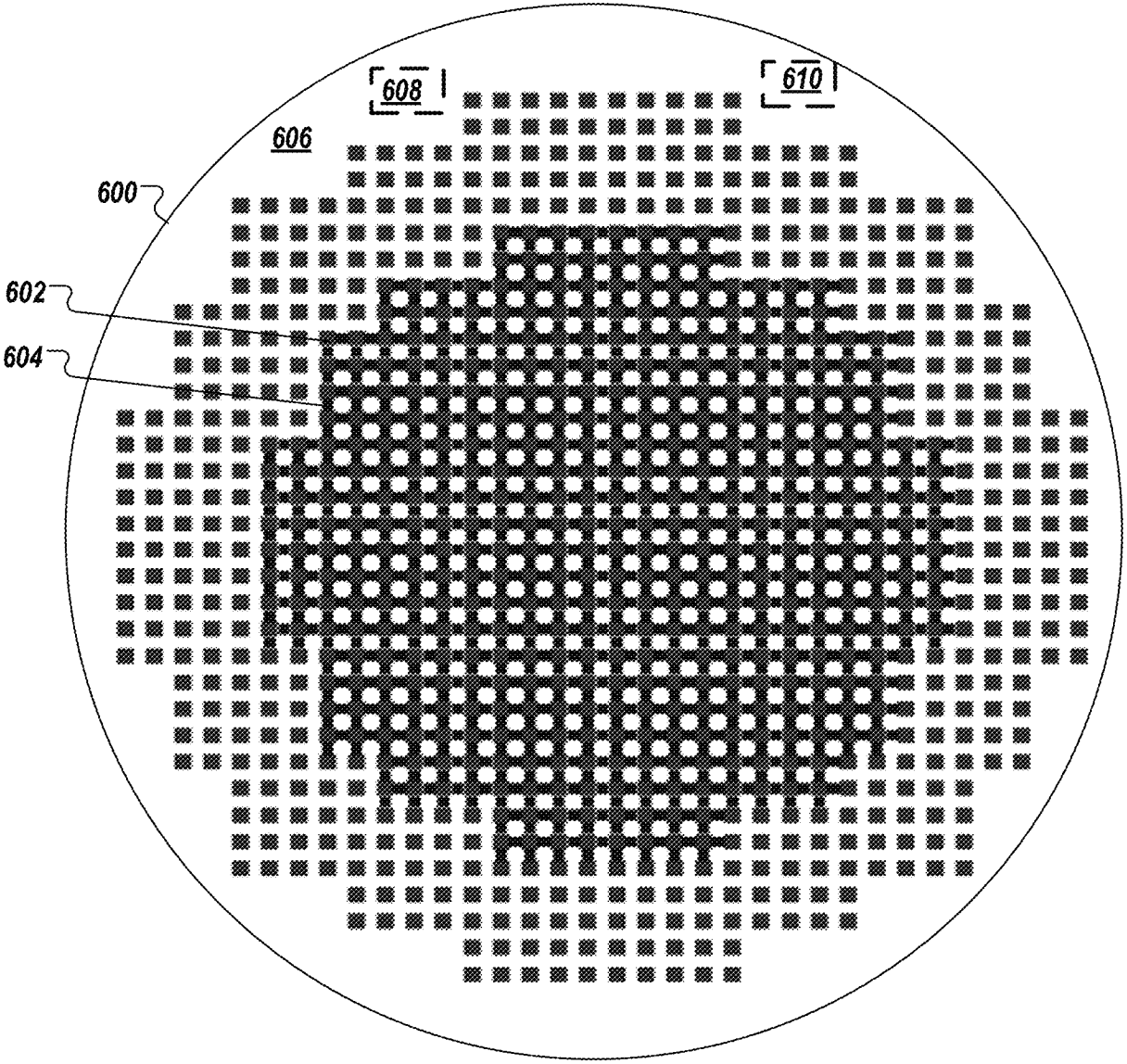
FIG. 6 illustrates an aperture of a wireless device within which two interleaved phased array antennas are disposed according to one embodiment.

FIG. 6 illustrates an aperture 600 of a wireless device within which two interleaved phased array antennas are disposed according to one embodiment. The aperture 600 is an opening in conductive materials above elements of the two interleaved phased array antennas, including a first phased array antenna 602 and a second phased array antenna 604. The aperture 600 is a circular shape and in which the geometric shape of the first phased array antenna 602 fits. As described herein, the geometric shape of the second phased array antenna 604 fits within the gaps between the elements of the first phased array antenna 602. In another embodiment, the aperture 600 is other shapes and sizes, constrained by an area of the elements of the first phased array antenna 602. The area of the elements is defined by a size of each element and an inter-element spacing between elements. The inter-element spacing is selected to permit an inter-element spacing that allows elements of a second size and with a second inter-element spacing between elements of the second phased array antenna 604 to fit within the gaps between the elements of the first phased array antenna 602.

In one embodiment, the elements of the first phased array antenna 602 and the elements of the second phased array antenna 604 are disposed on a support structure 606 within the aperture 600. The support structure 606 can be a circuit board with a first surface upon which the elements are disposed. Electronics can be disposed on a second surface of the circuit board. For example, a first radio 608 that operates in a first frequency band and a second radio 610 that operates in a second frequency band are disposed on the second surface of the circuit board. The first frequency band is lower in frequency than the second frequency band. The first radio 608 and the second radio 610 are illustrated as dashed boxes to represent being positioned on the second surface of the support structure 606. Although illustrated at the edge of the support structure, the first radio 608 and the second radio 610 can be disposed at any location, even on the same surface as the elements of the first phased array antenna 602 and the second phased array antenna 604.

The elements of the first phased array antenna 602 are organized as a first lattice structure or a first grid. The elements of the second phased array antenna 604 are organized as a second lattice structure or a second grid. The first grid has a first inter-element spacing of a first distance between each of the elements of the first phased array antenna 602. Each of these elements has a first size that is proportional to a first wavelength corresponding to a frequency of the first frequency band. The second grid has a second inter-element spacing of a second distance between each of the elements of the second phased array antenna 604. Each of these elements has a second size that is proportional to a second wavelength corresponding to a frequency of the second frequency band. Since the second frequency band is higher than the first frequency band, the second distance is less than the first distance and the second size being less than the first size.

In some cases, the second grid is disposed within the spaces between the elements of the first grid. In other cases, the second grid is rotated 45 degrees with respect to the first grid to achieve a specific inter-element spacing ratio between the first inter-element spacing and the second inter-element spacing. The elements of the second phased array antenna 604 fit within the gaps of the first inter-element spacing in an interleaved fashion with the elements of the first phased array antenna 602.

As described above, the first phased array antenna 602 and the second phased array antenna 604 are constructed of unit cells. The unit cells can be identical tiles. Alternatively, the unit cells do not necessarily need to be identical to fit the elements of the second phased array antenna 604 within the spacing between the elements of the first phased array antenna 602. In one embodiment, the unit cell includes four elements for the first phased array antenna 602 and eight elements for the second phased array antenna 604. Alternatively, the unit cell includes two elements for the first phased array antenna 602 and four elements for the second phased array antenna 604. Alternatively, the unit cell includes eight elements for the first phased array antenna 602 and sixteen elements for the second phased array antenna 604. Alternatively, other combination of elements from the first phased array antenna 602 and the second phased array antenna 604 can be used.

In another embodiment, the elements of the first phased array antenna 602 are spaced apart by a first distance on a surface of the support structure 606 and the elements of the second phased array antenna 604 are located in spaces between the elements of the first phased array antenna 602 on the same surface. The elements of the second phased array antenna 604 are spaced apart by a second distance.

In one embodiment, the first size of the elements of the first phased array antenna 602 is proportional to a wavelength corresponding to the first frequency range (e.g., 30 GHz frequency band) and the second size of the elements of the second phased array antenna 604 is proportional to a wavelength corresponding to the second frequency range (e.g., 20 GHz). In one embodiment, the first frequency range is between approximately 27.5 GHz and approximately 31 GHz. In one embodiment, the second frequency range is between approximately 18.3 GHz and approximately 20.2 GHz. Alternatively, other frequency ranges can be used.

In one embodiment, the first inter-element spacing of the first distance between elements of the first phased array antenna 602 is 1.5 times greater than the second inter-element spacing of the second distance between elements of the second phased array antenna 604. That is, the first distance is $\sqrt{2}$ times greater than the second distance. Alternatively, other ratios or multipliers of the inter-element spacing between the two phased array antennas can be used.

As described above with respect to FIGS. 4B-5, the elements can be organized with specific feed orientations, such as to create a sequential rotation of feeds of a group of elements. For example, each of the four elements for the first phased array antenna 602 in a unit cell can be arranged such that each element is at a corner of a first square shape. Eight elements for the second phased array antenna 604 in the unit cell can be arranged in a first set of four elements, each of the first set being arranged at a corner of a second square shape, and in a second set of four elements, each of the second set being arranged at a corner of a third square shape. The second square shape can be positioned to straddle two of the four elements of the first square shape in a first direction and the third square shape can be positioned to straddle two of the four elements of the first square shape in a second direction that is orthogonal to the first direction. Alternatively, the groupings of elements can vary.

Although the various elements of the first phased array antenna 602 and the second phased array antenna 604 are represented in the figures as square elements any size or type of antenna can be located at the corresponding square element. In some cases, the antenna elements are square-shape patch antenna elements. In another embodiment, the antenna elements are slots in material as slot elements. Alternatively, the elements can be other types of antenna element types that are used in phased array antennas. Alternatively, the elements are not necessarily part of a phased array antenna, but a group of elements that can be used for other wireless communications than beam steering.

Figure 7:
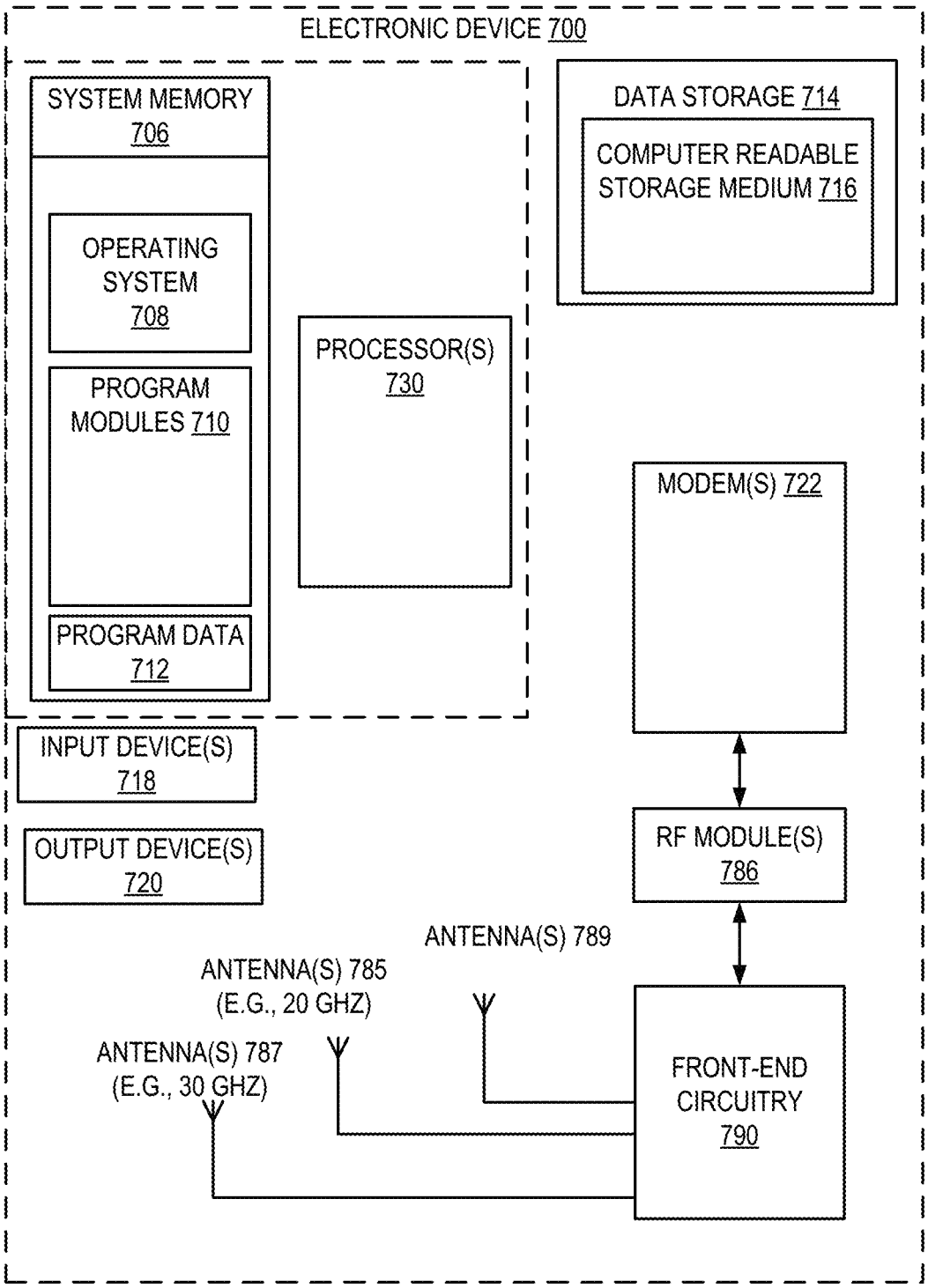
FIG. 7 is a block diagram of an electronic device that includes two interleaved phased array antennas as described herein according to one embodiment.

FIG. 7 is a block diagram of an electronic device that includes a two interleaved phased array antennas 785, 787 as described herein according to one embodiment. In one embodiment, the electronic device 700 includes the two interleaved phased array antennas 102, 104 of FIG. 1. In another embodiment, the electronic device 700 includes the two interleaved phased array antennas 202, 204 of FIG. 2. In another embodiment, the electronic device 700 includes the two interleaved phased array antennas 302, 304 of FIG. 3. In another embodiment, the electronic device 700 includes the two interleaved phased array antennas 402, 404 of FIG. 4. In another embodiment, the electronic device 700 includes the two interleaved phased array antennas of FIG. 5. In another embodiment, the electronic device 700 includes the two interleaved phased array antennas 602, 605 of FIG. 6. Alternatively, the electronic device 700 may be other electronic devices, as described herein.

The electronic device 700 includes one or more processor(s) 730, such as one or more CPUs, microcontrollers, field programmable gate arrays, or other types of processors. The electronic device 700 also includes system memory 706, which may correspond to any combination of volatile and/or non-volatile storage mechanisms. The system memory 706 stores information that provides operating system component 708, various program modules 710, program data 712, and/or other components. In one embodiment, the system memory 706 stores instructions of methods to control operation of the electronic device 700. The electronic device 700 performs functions by using the processor(s) 730 to execute instructions provided by the system memory 706.

The electronic device 700 also includes a data storage device 714 that may be composed of one or more types of removable storage and/or one or more types of non-removable storage. The data storage device 714 includes a computer-readable storage medium 716 on which is stored one or more sets of instructions embodying any of the methodologies or functions described herein. Instructions for the program modules 710 may reside, completely or at least partially, within the computer-readable storage medium 716, system memory 706 and/or within the processor(s) 730 during execution thereof by the electronic device 700, the system memory 706, and the processor(s) 730 also constituting computer-readable media. The electronic device 700 may also include one or more input devices 718 (keyboard, mouse device, specialized selection keys, etc.) and one or more output devices 720 (displays, printers, audio output mechanisms, etc.).

The electronic device 700 further includes a modem 722 to allow the electronic device 700 to communicate via a wireless connections (e.g., such as provided by the wireless communication system) with other computing devices, such as remote computers, an item providing system, and so forth. The modem 722 can be connected to one or more radio frequency (RF) modules 786. The RF modules 786 may be a wireless local area network (WLAN) module, a wide area network (WAN) module, wireless personal area network (WPAN) module, Global Positioning System (GPS) module, or the like. The antenna structures (antenna(s) 785, 787, 789) are coupled to the front-end circuitry 790, which is coupled to the modem 722. The front-end circuitry 790 may include radio front-end circuitry, antenna switching circuitry, impedance matching circuitry, or the like. The antennas 785, 787, 789 may be GPS antennas, Near-Field Communication (NFC) antennas, other WAN antennas, WLAN or PAN antennas, or the like. The modem 722 allows the electronic device 700 to handle both voice and non-voice communications (such as communications for text messages, multimedia messages, media downloads, web browsing, etc.) with a wireless communication system. The modem 722 may provide network connectivity using any type of mobile network technology including, for example, Cellular Digital Packet Data (CDPD), General Packet Radio Service (GPRS), EDGE, Universal Mobile Telecommunications System (UMTS), Single-Carrier Radio Transmission Technology (1xRTT), Evaluation Data Optimized (EVDO), High-Speed Down-Link Packet Access (HSDPA), Wi-Fi®, Long Term Evolution (LTE) and LTE Advanced (sometimes generally referred to as 4G), etc.

The modem 722 may generate signals and send these signals to antenna(s) 785, 787, 789 of a first type (e.g., 20 GHz), antenna(s) 785 of a second type (e.g., 30 GHz), and/or antenna(s) 787 of a third type (e.g., WAN, WLAN, PAN, or the like), via front-end circuitry 790, and RF module(s) 786 as descried herein. Antennas 785, 787, 789 may be configured to transmit in different frequency bands and/or using different wireless communication protocols. The antennas 785, 787, 789 may be directional, omnidirectional, or non-directional antennas. In addition to sending data, antennas 785, 787, 789 may also receive data, which is sent to appropriate RF modules connected to the antennas. One of the antennas 785, 787, 789 may be any combination of the antenna structures described herein.

In one embodiment, the electronic device 700 establishes a first connection using a first wireless communication protocol, and a second connection using a different wireless communication protocol. The first wireless connection and second wireless connection may be active concurrently, for example, if an electronic device is receiving a media item from another electronic device via the first connection) and transferring a file to another electronic device (e.g., via the second connection) at the same time. Alternatively, the two connections may be active concurrently during wireless communications with multiple devices. In one embodiment, the first wireless connection is associated with a first resonant mode of an antenna structure that operates at a first frequency band and the second wireless connection is associated with a second resonant mode of the antenna structure that operates at a second frequency band. In another embodiment, the first wireless connection is associated with a first antenna structure and the second wireless connection is associated with a second antenna.

Though a modem 722 is shown to control transmission and reception via antenna (785, 787, 789), the electronic device 700 may alternatively include multiple modems, each of which is configured to transmit/receive data via a different antenna and/or wireless transmission protocol.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to convey the substance of their work most effectively to others skilled in the art. An algorithm is used herein, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," "determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, Read-Only Memories (ROMs), compact disc ROMs (CD-ROMs) and magnetic-optical disks, Random Access Memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A wireless device comprising:

a support structure;

a first radio that operates in a first frequency band;

a second radio that operates in a second frequency band, the first frequency band being lower in frequency than the second frequency band;

a first phased array antenna coupled to the first radio, the first phased array antenna comprising a first plurality of antenna elements disposed on a surface of the support structure, the first plurality of antenna elements being organized as a first grid;

a second phased array antenna coupled to the second radio, the second phased array antenna comprising a second plurality of antenna elements disposed on the surface of the support structure, the second plurality of antenna elements being organized as a second grid rotated 45 degrees with respect to the first grid and each antenna element is disposed between two adjacent elements of the first grid, wherein:

the first phased array antenna and the second phased array antenna are constructed with a plurality of unit cells, each unit cell consisting of:

a first set of four antenna elements of the first plurality of antenna elements organized in a square pattern in a first corner of the unit cell;

a second set of four antenna elements of the second plurality of antenna elements, each disposed between two antenna elements of the first set of four antenna elements; and a third set of four antenna elements of the second plurality of antenna elements, each disposed adjacent to one antenna element of the first set of four antenna elements.

2. The wireless device of claim 1, wherein each of the plurality of unit cells comprises:

i) a first element coupled to a first feed with a first orientation, ii) a second element coupled to a second feed with a second orientation, iii) a third element coupled to a third feed with a third orientation, the third orientation being opposite the first orientation, and iv) a fourth element coupled to a fourth feed with a fourth orientation, the fourth orientation being opposite the second orientation, wherein the first element, the second element, the third element, and the fourth element are organized in a first square pattern;

v) a fifth element coupled to a fifth feed with the first orientation, vi) a sixth element coupled to a sixth feed with the second orientation, vii) a seventh element coupled to a seventh feed with the third orientation, and viii) an eighth element coupled to an eighth feed with the fourth orientation, wherein the fifth element, the sixth element, the seventh element, and the eighth element are organized in a second square pattern;

ix) a ninth element coupled to a ninth feed with the first orientation, and x) a tenth element coupled to a tenth feed with the fourth orientation, wherein the ninth element and the tenth element are part of a third square pattern with elements from at least two adjacent unit cells of the plurality of unit cells;

xi) an eleventh element coupled to an eleventh feed with the third orientation, the eleventh element being part of a fourth square pattern with elements from at least two adjacent unit cells of the plurality of unit cells; and xii) a twelfth element coupled to a twelfth feed with the second orientation, the twelfth element being part of a fifth square pattern with elements from at least two adjacent unit cells of the plurality of unit cells.

3. An apparatus comprising:

a support structure;

a first antenna comprising a first plurality of antenna elements disposed on a surface of the support structure, wherein two adjacent antenna elements of the first plurality of antenna elements are separated by a first distance; and a second antenna comprising a second plurality of antenna elements disposed on the surface of the support structure, wherein each antenna element of the second plurality of antenna elements is located between two adjacent antenna elements of the first plurality of antenna elements and wherein two adjacent elements of the second plurality of antenna elements are separated by a second distance that is less than the first distance, wherein the first antenna and the second antenna are constructed with a plurality of unit cells, each unit cell consisting of:

a first set of four antenna elements of the first plurality of antenna elements organized in a square pattern in a first corner of the unit cell;

a second set of four antenna elements of the second plurality of antenna elements, each disposed between two antenna elements of the first set of four antenna elements; and a third set of four antenna elements of the second plurality of antenna elements, each disposed adjacent to one antenna element of the first set of four antenna elements.

4. The apparatus of claim 3, wherein the first antenna is configured to operate in a first frequency range and the second antenna is configured to operate in a second frequency range that is higher in frequency than the first frequency range, wherein each of the first plurality of antenna elements has a first size and each of the second plurality of antenna elements has a second size that is smaller than the first size.

5. The apparatus of claim 4, wherein the first size is proportional to a wavelength corresponding to the first frequency range and the second size is proportional to a wavelength corresponding to the second frequency range.

6. The apparatus of claim 3, the first distance is approximately $\sqrt{2}$ times greater than the second distance.

7. The apparatus of claim 3, wherein the first plurality of antenna elements are organized as a first grid and the second plurality of antenna elements are organized as a second grid, wherein the second grid is rotated 45 degrees with respect to the first grid.

8. The apparatus of claim 3, wherein the first plurality of antenna elements are organized as a first grid and the second plurality of antenna elements are organized as a second grid, wherein the second grid is rotated by an angle value with respect to the first grid.

9. The apparatus of claim 3, wherein:

the first antenna is configured to operate in a first frequency range between approximately 27.5 GHz and approximately 31 GHz;

the second antenna is configured to operate in a second frequency range between approximately 18.3 GHz and approximately 20.2 GHz; and the first distance is approximately 1.5 times greater than the second distance.

10. The apparatus of claim 3, wherein:

the first set of four antenna elements are each arranged at a respective corner of a first square shape;

two of the second set of four antenna elements and two of the third set of four antenna elements are each arranged at a respective corner of a second square shape;

two of the second set of four antenna elements and two of the third set of four antenna elements are each arranged at a respective corner of a third square shape;

the second square shape is positioned to straddle two antenna elements of the first set of four antenna elements of the first square shape in a first direction; and the third square shape is positioned to straddle two antenna elements of the first set of four antenna elements of the first square shape in a second direction that is orthogonal to the first direction.

11. A wireless device comprising:

a support structure;

a first radio;

a second radio;

a first antenna coupled to the first radio, the first antenna comprising a first plurality of antenna elements disposed on a surface of the support structure, wherein two adjacent antenna elements of the first plurality of antenna elements are separated by a first distance; and a second antenna coupled to the second radio, the second antenna comprising a second plurality of antenna elements disposed on the surface of the support structure, wherein each antenna element of the second plurality of antenna elements is located between two adjacent antenna elements of the first plurality of antenna elements, and wherein two adjacent elements of the second plurality of antenna elements are separated by a second distance that is less than the first distance, and wherein the first antenna and the second antenna are constructed with a plurality of unit cells, each unit cell consisting of:

a first set of four antenna elements of the first plurality of antenna elements organized in a square pattern in a first corner of the unit cell;

a second set of four antenna elements of the second plurality of antenna elements, each disposed between two antenna elements of the first set of four antenna elements; and a third set of four antenna elements of the second plurality of antenna elements, each disposed adjacent to one antenna element of the first set of four antenna elements.

12. The wireless device of claim 11, wherein:

the first plurality of antenna elements are organized as a first grid; and the second plurality of antenna elements are organized as a second grid, the second grid being rotated by a specified angle with respect to the first grid; and each of the second plurality of antenna elements is located between two adjacent antenna elements of the first plurality of antenna elements.

13. The wireless device of claim 11, wherein:

the first radio is configured to operate in a first frequency band;

the second radio is configured to operation in a second frequency band, the first frequency band being lower in frequency than the second frequency band;

each of the first plurality of antenna elements has a first size that is proportional to a first wavelength corresponding to a frequency of the first frequency band; and each of the second plurality of antenna elements has a second size that is proportional to a second wavelength corresponding to a frequency of the second frequency band, the second size being less than the first size.

14. The wireless device of claim 13, wherein:

the first distance is approximately 1.5 times greater than the second distance;

the first frequency band is a first frequency range between approximately 27.5 GHz and approximately 31 GHz; and the second frequency band is a second frequency range between approximately 18.3 GHz and approximately 20.2 GHz.

15. The wireless device of claim 11, wherein:

the first set of four antenna elements are each arranged at a respective corner of a first square shape;

two of the second set of four antenna elements and two of the third set of four antenna elements are each arranged at a respective corner of a second square shape;

two of the second set of four antenna elements and two of the third set of four antenna elements are each arranged at a respective corner of a third square shape;

the second square shape is positioned to straddle two antenna elements of the first set of four antenna elements of the first square shape in a first direction; and the third square shape is positioned to straddle two antenna elements of the first set of four antenna elements of the first square shape in a second direction that is orthogonal to the first direction.

16. The wireless device of claim 11, wherein each of the first plurality of antenna elements is a patch antenna and each of the second plurality of antenna elements is a patch antenna.

17. The wireless device of claim 11, wherein each of the plurality of unit cells comprises: i) a first element coupled to a first feed with a first orientation, ii) a second element coupled to a second feed with a second orientation, iii) a third element coupled to a third feed with a third orientation, the third orientation being opposite the first orientation, and iv) a fourth element coupled to a fourth feed with a fourth orientation, the fourth orientation being opposite the second orientation, wherein the first element, the second element, the third element, and the fourth element are organized in a first square pattern; and v) a fifth element coupled to a fifth feed with the first orientation, vi) a sixth element coupled to a sixth feed with the second orientation, vii) a seventh element coupled to a seventh feed with the third orientation, and viii) an eighth element coupled to an eighth feed with the fourth orientation, wherein the fifth element, the sixth element, the seventh element, and the eighth element are organized in a second square pattern.

18. The wireless device of claim 17, wherein each of the plurality of unit cells further comprises:

ix) a ninth element coupled to a ninth feed with the first orientation, and x) a tenth element coupled to a tenth feed with the fourth orientation, wherein the ninth element and the tenth element are part of a third square pattern with elements from at least two adjacent unit cells of the plurality of unit cells;

xi) an eleventh element coupled to an eleventh feed with the third orientation, the eleventh element being part of a fourth square pattern with elements from at least two adjacent unit cells of the plurality of unit cells; and xii) a twelfth element coupled to a twelfth feed with the second orientation, the twelfth element being part of a fifth square pattern with elements from at least two adjacent unit cells of the plurality of unit cells.

* * * * *